US005358671A

United States Patent [19]

Leiponen

[11] Patent Number: 5,358,671

[45] Date of Patent: Oct. 25, 1994

[54] AERATOR DEVICE

[75] Inventor: Matti O. Leiponen, Espoo, Finland

[73] Assignee: Outokumpu Mintec Oy, Espoo, Finland

[21] Appl. No.: 92,758

[22] Filed: Jul. 16, 1993

[30] Foreign Application Priority Data

Jul. 17, 1992 [FI] Finland ..... 923271

[51] Int. Cl.[5] ..... B01F 3/04

[52] U.S. Cl. ..... 261/87

[58] Field of Search ..... 261/87

[56] References Cited

U.S. PATENT DOCUMENTS 2,767,965 10/1956 Daman ..... 261/87
3,070,229 12/1962 Benozzo ..... 261/87
3,882,016 5/1975 Green ..... 261/87
4,425,232 1/1984 Lawrence et al. ..... 261/87
4,800,017 1/1989 Krishnaswamy ..... 261/87
4,925,598 5/1990 Kivisto et al. ..... 261/87

FOREIGN PATENT DOCUMENTS 0204688 1/1990 European Pat. Off. .
2521931 1/1976 Fed. Rep. of Germany ..... 261/87
5823036 3/1977 Japan .

*Primary Examiner*—Tim Miles
*Attorney, Agent, or Firm*—Smith-Hill and Bedell

[57] ABSTRACT

The invention relates to an aerator device where the stator is installed coaxially with the rotor and comprises several flow chutes extending outwards from the stator frame. According to the invention, the flow channel (8) comprises a first part (9) that is closed at the top, and an at least one-part flow chute (10, 12, 16, 20, 22, 24) that is open at the top.

25 Claims, 2 Drawing Sheets

Figure 4A:
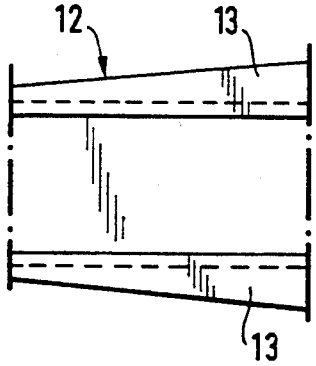

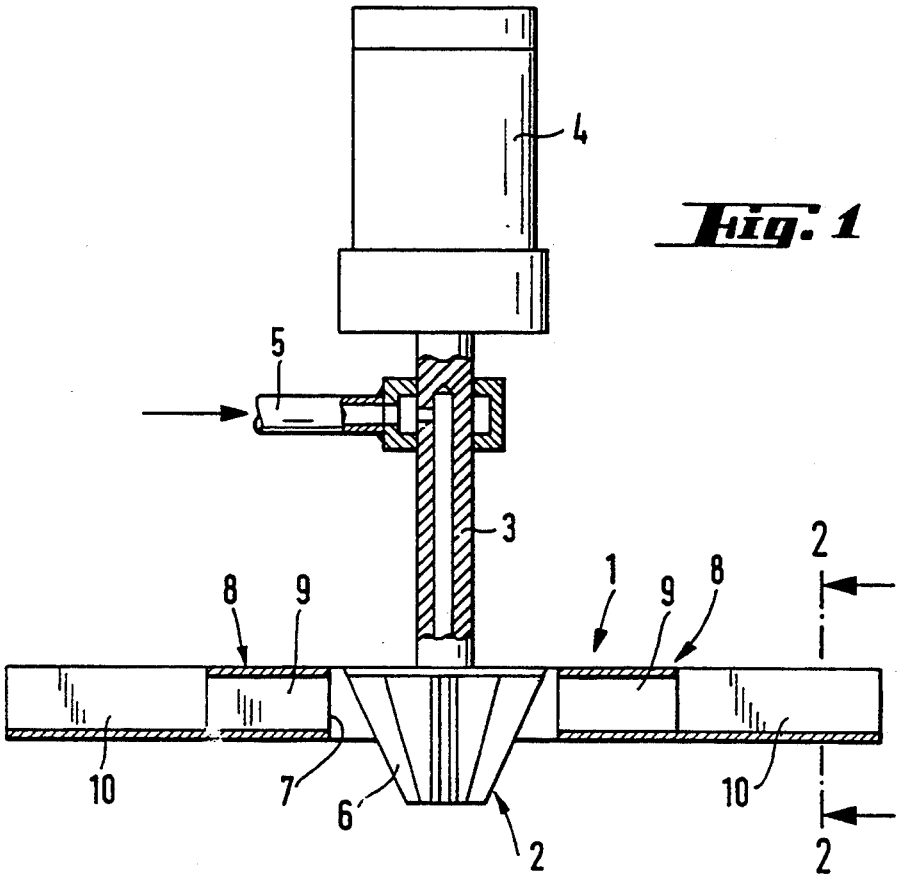
Fig. 1
Fig. 2a
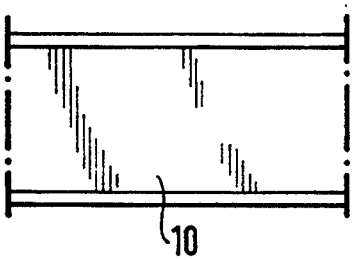
Fig. 2b
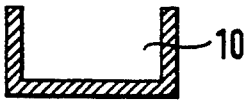
Fig. 3a
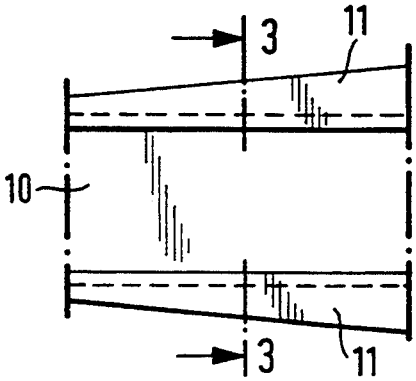
Fig. 3b
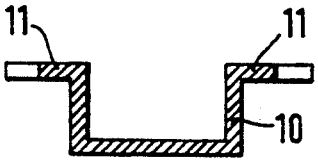

AERATOR DEVICE

The present invention relates to an aerator device, particularly the stator structure of an aerator device, where the stator is installed coaxially with the rotor, and the stator comprises several flow channels extending from the stator frame.

The JP utility model publication 23,036/1983 specifies a pump connected to the treatment of water and creating a small-size foam bubble; in the stator of the said pump, which is coaxial with the rotor wheel, there are formed rectangular flow channels by means of plates attached to opposite surfaces. Throughout their whole length, the flow channels are designed so that the liquid-air mixture flows out through channels closed on four sides, via the flow channel ends located on the outer circumference of the stator.

From the EP patent publication 204,688 there is known an aerating device for liquids, the stator whereof is provided with rectangular flow channels, which form a closet frame around the rotor. The flow channels are separated from each other with intermediate spaces that are wedge-like at the first end, so that the peak of these wedges is located immediately in between the adjacent orifices. In addition to this, the flow channels are designed so that the vertical boundary surfaces of the flow channels are either parallel or diverge or converge at an angle of 7 degrees. On the other hand, the horizontal boundary surfaces of the flow channels are parallel and thus located at a regular distance from each other throughout the flow channel. Thus the flow channels are closed along their whole length on four sides, and the gas-air mixture is let out of the flow channels through their orifices located on the outer circumference of the stator.

The EP patent 294,736 introduces an aerator device for industrial and household sewage, where the stator, installed coaxially with the rotor, comprises a stator casing structure, pipes directed out of the outer edge of the casing structure, stator legs directed downwards of the stator casing, and blade members attached to the legs. The stator pipes of the aerator are directed either radially or tangentially with respect to the rotor. The stator pipes are closed along their whole length, so that the liquid-gas mixture is let out of the stator pipe orifices located on the outer circumference of the stator.

All of the above described publications represent aerators which are installed near the bottom of an aerating reactor and are meant for either pumping or dispersing. The operation of these aerators is intensified by means of flow channels, where the liquid-gas mixture can be discharged only through the flow channels located on the outer circumference of the stator. The described devices are workable as such, but the length of their flow channels is generally limited to the region 0.5–1.0 meters, because air is collected to the top part of the pipes and accumulated into big bubbles. However, in large aeration tanks it is important to take the liquid-gas mixture as far as possible from the aerator device in order to achieve an advantageous result. We have now made the surprising observation that by remodelling the flow channels known as such from the above described devices, improved aeration-technical results are achieved.

Accordingly, the object of the present invention is to achieve an improved aerator device suited for the treatment of different waste waters, where a remodelling of the flow channels advantageously makes the flow channels longer than before, and thus the liquid-gas mixture is discharged from the flow channels in a way that is aeration-technically more favourable.

In the aerator device according to the invention, in the stator installed coaxially with the rotor there are formed at least three flow channels extending from the inner circumference of the stator; the first part of the flow channels is closed in cross-section, but after a desired length the flow channels are changed to be open in cross-section, so that the top part of the flow channel is open, i.e. the second or end part of the flow channel forms a flow chute that is open at the top. The length of the flow chute is advantageously at least 30% of the total length of the first part of the flow channel and the flow chute. The first part of the flow channel can be for instance essentially rectangular or tubular in cross-section. Likewise, the flow chute can in cross-section be for instance an essentially rectangular chute open at the top, so that the chute is formed of two essentially vertical side walls and of an essentially horizontal bottom connecting the side walls, or it can be curved in cross-section and open at the top, so that one or several curved pieces form the side walls and bottom of the chute. In height, the side walls of the flow chute can be either increasing or decreasing from the stator outwards. Moreover, the flow chute can be so designed in cross-section, that the side walls are inclined with respect to the chute bottom, which is made horizontal. According to the invention, the second part of the flow channel, i.e. the open flow chute, can thus be designed so that the side walls of the chute are rectilinear or curved in cross-section, that the side walls are either mutually parallel or diverging or converging, while the angle between the side walls is 5–7 degrees. The side walls of the flow chute can be arranged in a vertical or slanted position. The bottom of the flow chute can likewise be either curved or rectilinear in cross-section. The flow chute of the aerator of the invention can also be designed so that the flow chute is formed of two intersecting planes that are either rectilinear or curved in cross-section, which planes as such constitute the side walls of the flow chute, and their intersection forms the bottom of the flow chute.

By designing the second part of the flow channel as an open chute according to the invention, the accumulation of the liquid-gas mixture in the top part of the flow channel is prevented, and consequently the bubble size, which is an important factor in aeration, is prevented from growing prior to the discharge of the liquid-gas mixture from the flow channel into the liquid to be aerated. Although part of the liquid-gas mixture passing through the flow channel falls outside the guiding influence of the flow channel, this stray part of the liquid-gas mixture essentially has a small bubble size and is thus advantageous for a good aerating result. However, with the flow channel structure of the invention, a larger part of the liquid-gas mixture is conducted advantageously far from the vicinity of the aerator unit, so that the aeration result is advantageously improved. Thus the stator structure of the invention causes the liquid-gas mixture to be discharged in an advantageous fashion over an essentially long distance, and not only from the end of the channel, which as such helps to achieve a better aeration result.

The side walls in the second part of the flow channel of the aerator device of the invention can also be provided with external, at least single-part expansion blades, in which case essentially vertical external currents can be prevented. Advantageously the expansion blades are expanded from the stator outwards. The expansion blades are either at least partly rectilinear or at least partly curved, and they can advantageously be arranged for instance in an inclined or horizontal position with respect to the side wall of the flow chute.

The second part of the flow channel of the aerator device of the invention can also be designed so that it is composed of at least two nested flow chutes. Also in this case the side walls may be arranged in a mutually diverging or converging fashion, either in one or several nested flow chutes. In the longitudinal direction, the flow chute of the aerator device of the invention can also be composed of several parts, so that in the successively installed parts of the flow chute, the side walls of the first part can be for instance parallel, and in the second part for instance mutually diverging or converging.

The invention is explained in more detail below, with reference to the appended drawings where FIG. 1 is a side-view illustration of a preferred embodiment of the invention, seen in partial cross-section;

FIG. 2*a* illustrates the flow chute of the embodiment of FIG. 1, seen from the top;

FIG. 2*b* is a sectional view taken on the line 2—2 of FIG. 1;

FIG. 3*a* illustrates another preferred embodiment of the flow chute of the invention, seen from the top;

FIG. 3*b* is a sectional view taken on the line 3—3 of FIG. 3*a;*

Figure 4B:
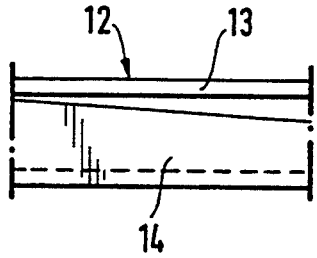
Figure 4C:
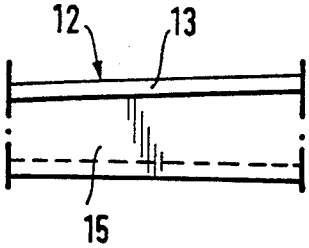

FIG. 4*a* illustrates yet another preferred embodiment of the flow chute of the invention, seen from the top;

FIG. 4*b* illustrates a side elevation of one form of the flow chute shown in FIG. 4*a* and FIG. 4*c* illustrates a side elevation of a modified form of the flow chute shown in FIG. 4*a;*

Figure 5A:
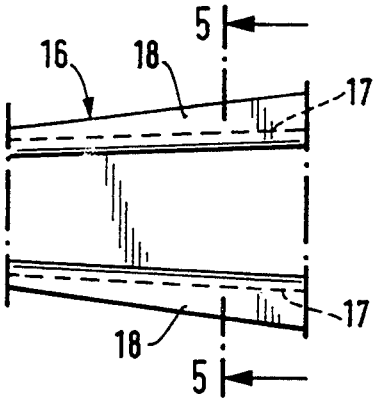
Figure 5B:
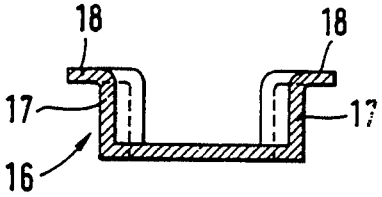

FIG. 5*a* illustrates yet another preferred embodiment of the flow chute of the invention, seen from the top;

FIG. 5*b* illustrates a sectional view taken on the line 5—5 in FIG. 5*a;*

Figure 6A:
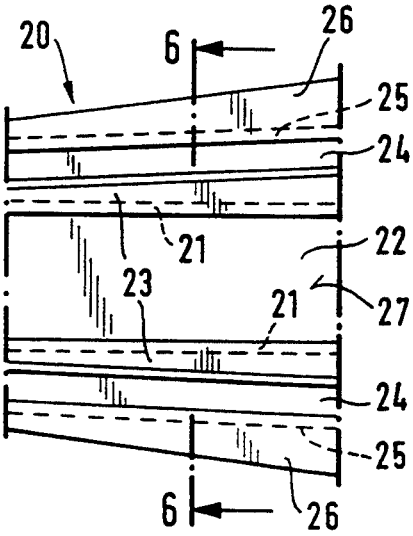
Figure 6B:
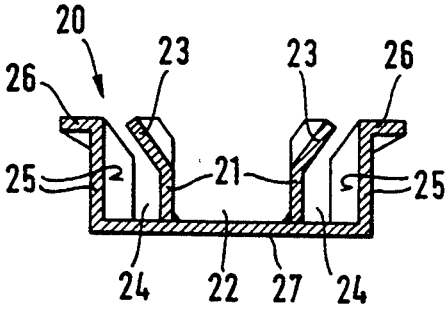

FIG. 6*a* illustrates yet another preferred embodiment of the flow chute of the invention, seen from the top;

FIG. 6*b* illustrates a sectional view taken on the line 6—6 in FIG. 6*a*.

According to FIG. 1, the stator 1 of the aerator device is submerged in water and installed coaxially with a rotor 2, which rotor 2 is rotated by a motor 4 connected to a shaft 3. The shaft 3 is hollow, and through the shaft 3, the air supplied from the pipe 5 is conducted to the rotor blades 6. The air flowing from the rotor blades 6 is mixed with surrounding water. The created water-air mixture is directed from the inner circumference 7 of the stator to the outwardly extending flow channels 8. The first part 9 of the flow channel 8 is closed, so that the water-air mixture supplied in the whole flow channel 8 is discharged from the orifice of the closed first part 9. According to the invention, to the first part 9 of the flow channel, there is connected a flow chute 10 which is open at the top. From the flow chute 10, part of the water-air mixture is let out already before reaching the outer end of the chute 10, so that the water-air mixture is discharged in the area of the flow channels 8 more homogeneously than if the discharge should take place, as in the state of the art, only from the orifice of a closed flow channel. FIG. 2*a* illustrates the flow chute 10 of the embodiment of FIG. 1, seen from the top, and FIG. 2*b* illustrates the same chute 10 as a cross-section along the line 2—2 of FIG. 1. The flow chute 10 illustrated in FIGS. 2*a* and 2*b* is essentially rectangular and essentially resembles U-profile in cross-section.

FIG. 3 illustrates a corresponding preferred embodiment of the invention as in FIG. 2, provided with planar expansion blades 11, when seen from above (FIG. 3*a*) and as a cross-section along the line 3—3 (FIG. 3*b*). The expansion blades 11 are designed so that the width of the blades 11 increases from the stator of the flow chute 10 outwards, and the expansion blades 11 are arranged on an essentially parallel plane with the bottom of the flow chute 10. By means of the expansion blades 11, vertical currents possibly created in the vicinity of the flow chute 10 by the water-air mixture discharged from the flow chute 10 can advantageously be reduced.

In FIG. 4*a*, the flow chute 12 is provided with expansion blades 13, and as the width of the expansion blades 13 increases, from the stator outwards, the height of the side walls 14 of the flow chute 12 decreases, as is illustrated in FIG. 4*b*, or the height of the side walls 15 of the flow chute increases from the stator 1 outwards, as is illustrated in FIG. 4*c*.

In FIG. 5*a*, the side walls 17 of the flow chute 16 diverge from each other, and the angle between the side walls 17 is 5 degrees. The flow channel 16 is provided with expansion blades 18, expanding from the stator outwards. The expansion blades 18 are designed so, that the expansion blades 18 extend from the side walls 17, having an outwardly decreasing height with respect to the stator, in curved fashion (FIG. 5*b*), so that the distance of the outer edge of the expansion blades 18 from the plane defined by the bottom of the flow chute 16 remains essentially constant throughout the whole length of the flow chute 16.

In FIG. 6*a*, the flow chute 20 comprises two nested flow chutes. The walls 21 form the inner flow chute 22. The side walls 21 of the flow chute 22 are mutually parallel. In height, the side walls 21 decrease from the stator outwards. In the side walls 21, there are provided inclined planar expansion blades 23, so that the distance of the outer edge of the expansion blades 23 from the plane defined by the bottom 27 of the flow chute 22 remains essentially constant throughout the whole length of the flow chute 22. The outer flow chute 24 of the flow chute 20 is formed by the side walls 25, which diverge from the stator outwards, the angle between them being 5 degrees. The side walls 25 of the outer flow chute 24 are provided with planar expansion blades 26, which are widened from the stator outwards.

I claim:

1. An aerator comprising a stator defining a central axis, and a rotor mounted for rotation relative to the stator about said central axis, and wherein the stator comprises wall portions defining a plurality of flow channels extending radially relative to the central axis and open radially at each end, each flow channel having an inner part and an outer part, the inner part being defined between two lateral walls and being closed both at the top and at the bottom, and the outer part being open at the top.

2. An aerator according to claim 1, wherein the outer part of the flow channel is defined between two side walls and a bottom wall connecting the side walls.

3. An aerator according to claim 1, wherein the outer part of the flow channel is defined between two side walls that are substantially parallel with each other.

4. An aerator according to claim 1, wherein the outer part of the flow channel is defined between two side walls that are mutually diverging in a radial direction away from the central axis.

5. An aerator according to claim 1, wherein the outer part of the flow channel is defined between two side walls that are mutually converging in a radial direction away from the central axis.

6. An aerator according to claim 1, wherein the outer part of the flow channel is defined between two side walls of which the extent in a direction parallel to the central axis decreases in a radial direction away from the central axis.

7. An aerator according to claim 1, wherein the outer part of the flow channel is defined between two side walls of which the extent in a direction parallel to the central axis increases in a radial direction away from the central axis.

8. An aerator according to claim 1, wherein the outer part of the flow channel is defined between two side walls that are substantially perpendicular to a plane perpendicular to the central axis.

9. An aerator according to claim 1, wherein the outer part of the flow channel is defined between two side walls that are inclined relative to a plane perpendicular to the central axis.

10. An aerator according to claim 1, wherein the outer part of the flow channel is defined between first and second opposite side walls and the stator further comprises at least one expansion blade that extends from the first side wall away from the second side wall and longitudinally of the first side wall.

11. An aerator according to claim 10, wherein the stator comprises a second expansion blade that extends from the second side wall away from the first side wall and longitudinally of the second side wall.

12. An aerator according to claim 10, wherein the expansion blade has an upper surface that is substantially rectinlinear in a cross-section of the flow channel.

13. An aerator according to claim 10, wherein the extent of the expansion blade in a direction perpendicular to the length of the flow channel increases with distance from the central axis.

14. An aerator according to claim 10, wherein the expansion blade is inclined relative to a plane perpendicular to the central axis.

15. An aerator according to claim 10, wherein the expansion blade is at least partly curved in a cross-section of the flow channel.

16. An aerator according to claim 1, wherein the outer part of the flow channel is divided into at least two sub-channels by at least one intermediate wall that extends longitudinally of the flow channel.

17. An aerator according to claim 16, wherein the stator further comprises an expansion blade that extends from the intermediate wall away from the first or second side wall and longitudinally of the intermediate wall.

18. An aerator according to claim 17, wherein the expansion blade is inclined relative to a plane perpendicular to the central axis.

19. An aerator according to claim 1, wherein the outer part of the flow channel is defined between two opposite side walls, and the stator comprises an intermediate wall that is disposed between the two side walls and divides the outer part of the flow channel longitudinally into two parallel sub-channels.

20. An aerator according to claim 1, wherein the outer part of the flow channel comprises two segments that are arranged successively in the longitudinal direction of the flow channel.

21. An aerator according to claim 1, wherein the outer part of the flow channel is formed of at least one component that is curved in a cross-section of the flow channel.

22. An aerator according to claim 1, wherein the outer part of the flow channel is defined between two opposite side walls that are rectinlinear in a cross-section of the flow channel and a bottom wall that is curved in a cross-section of the flow channel.

23. An aerator according to claim 1, wherein the outer part of the flow channel is defined between two opposite side walls that are curved in a cross-section of the flow channel and a bottom wall that is rectilinear in a cross-section of the flow channel.

24. An aerator according to claim 1, wherein the outer part of the flow channel is defined by two intersecting planes.

25. An aerator according to claim 1, comprising a shaft on which the rotor is mounted and a motor coupled drivingly to the shaft for rotating the rotor about said central axis, said shaft being hollow and defining a passage for delivering gas to the rotor.

* * * * *